US007350864B1

(12) United States Patent
Brewster

(10) Patent No.: US 7,350,864 B1
(45) Date of Patent: Apr. 1, 2008

(54) RECLINING ROCKER CHAIR WITH INFLATABLE LUMBAR SUPPORT

(76) Inventor: Sophia Brewster, 100 Dreiser Loop #9H, Bronx, NY (US) 10475

( * ) Notice: Subject to any disclaimer, the term of this patent is extended or adjusted under 35 U.S.C. 154(b) by 0 days.

(21) Appl. No.: 11/387,830

(22) Filed: Mar. 23, 2006

Related U.S. Application Data

(60) Provisional application No. 60/664,526, filed on Mar. 23, 2005.

(51) Int. Cl.
*A47C 3/02* (2006.01)

(52) U.S. Cl. ..... 297/284.6; 297/260.2

(58) Field of Classification Search ..... 297/284.4, 297/284.6, 260.2
See application file for complete search history.

(56) References Cited

U.S. PATENT DOCUMENTS 4,634,179 A * 1/1987 Hashimoto et al. ..... 297/284.6
4,655,505 A * 4/1987 Kashiwamura et al. .. 297/284.6
4,707,027 A * 11/1987 Horvath et al. ..... 297/284.6
4,833,614 A * 5/1989 Saitoh et al. ..... 297/284.6
4,938,528 A * 7/1990 Scott ..... 297/284.6
4,966,413 A * 10/1990 Palarski ..... 297/330
4,981,131 A * 1/1991 Hazard ..... 601/24
5,152,579 A * 10/1992 Bishai ..... 297/284.6
5,637,076 A * 6/1997 Hazard et al. ..... 601/5
5,792,082 A 8/1998 Yamanaka et al. ..... 601/148
5,902,011 A * 5/1999 Hand et al. ..... 297/284.6
6,058,341 A * 5/2000 Myers et al. ..... 297/284.6
6,290,661 B1 9/2001 Cutler et al. ..... 601/49
6,592,533 B1 7/2003 Yonekawa et al. ..... 601/148
6,682,059 B1 * 1/2004 Daniels et al. ..... 267/131
6,935,688 B2 * 8/2005 LaPointe ..... 297/284.6

* cited by examiner

*Primary Examiner*—Peter R. Brown
(74) *Attorney, Agent, or Firm*—Stephen Chin; von Simson & Chin LLP

(57) ABSTRACT

A reclining rocker chair, having a lower back support feature. The chair includes a base, a seat cushion, and a chair back extending upwardly from the base behind the seat cushion. The chair back has lower, middle, and upper sections. An inflatable chamber is located within the lower section of the chair back. A remote control provides the user with the option to inflate the inflatable chamber to provide lumbar support. A pressure sensor ensures that inflation pressure does not exceed predetermined limits for safely providing therapeutic support to the lower back.

4 Claims, 3 Drawing Sheets

RECLINING ROCKER CHAIR WITH INFLATABLE LUMBAR SUPPORT

CROSS REFERENCES AND RELATED SUBJECT MATTER

This application is a continuation of provisional patent application Ser. No. 60/664,526 filed in the United States Patent Office on Mar. 23, 2005.

BACKGROUND OF THE INVENTION

The invention relates to a reclining rocker chair. More particularly, the invention relates to a reclining rocker chair that has an inflatable chamber for providing enhanced lumbar support.

Lower back pain is one of the most common ailments in this country. Back pain sometimes results from an injury, and often results from poor posture and poor sitting and sleeping positions. Regardless of its source, back pain is sometimes debilitating and often uncomfortable. Back pain is a major source of a deteriorated quality of life for millions of Americans.

In addition to surgery and chiropractic adjustments, one of the best common treatments for lower back pain is to simply provide support to the lower back. Supporting the spine and lower back muscles helps alleviate pressure that is often the cause of the pain or which helps perpetuate the pain.

U.S. Pat. No. 5,792,082 to Yamanaka discloses a reclining chair that is capable of a rocking movement and is combined with an air mattress for providing a massage to the user.

U.S. Pat. No. 6,290,661 to Cutler discloses a chair having a vibratory massage element incorporated in the pillow that is actuated with a remote control.

U.S. Pat. No. 6,592,533 to Yonekawa appears to show an air massager seat having airbags that can be inflated or deflated using a control panel.

While these units may be suitable for the particular purpose employed, or for general use, they would not be as suitable for the purposes of the present invention as disclosed hereafter.

SUMMARY OF THE INVENTION

It is an object of the invention to produce a chair that provides support to the lower back. Accordingly the chair has an inflatable chamber that is selectively inflatable to provide firm support against the lumbar region of the lower back.

It is another object of the invention to provide a chair that is comfortable enough for everyday use. Accordingly the chair has reclining and rocking functions, and has a retractable leg rest.

It is a further object of the invention to provide a chair that is safe to use. Accordingly, a pressure sensor is incorporated within the inflatable chamber to ensure that the pressure does not exceed predetermined levels.

The invention is a reclining rocker chair, having a lower back support feature. The chair includes a base, a seat cushion, and a chair back extending upwardly from the base behind the seat cushion. The chair back has lower, middle, and upper sections. An inflatable chamber is located within the lower section of the chair back. A remote control provides the user with the option to inflate the inflatable chamber to provide lumbar support. A pressure sensor ensures that inflation pressure does not exceed predetermined limits for safely providing therapeutic support to the lower back.

To the accomplishment of the above and related objects the invention may be embodied in the form illustrated in the accompanying drawings. Attention is called to the fact, however, that the drawings are illustrative only. Variations are contemplated as being part of the invention.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
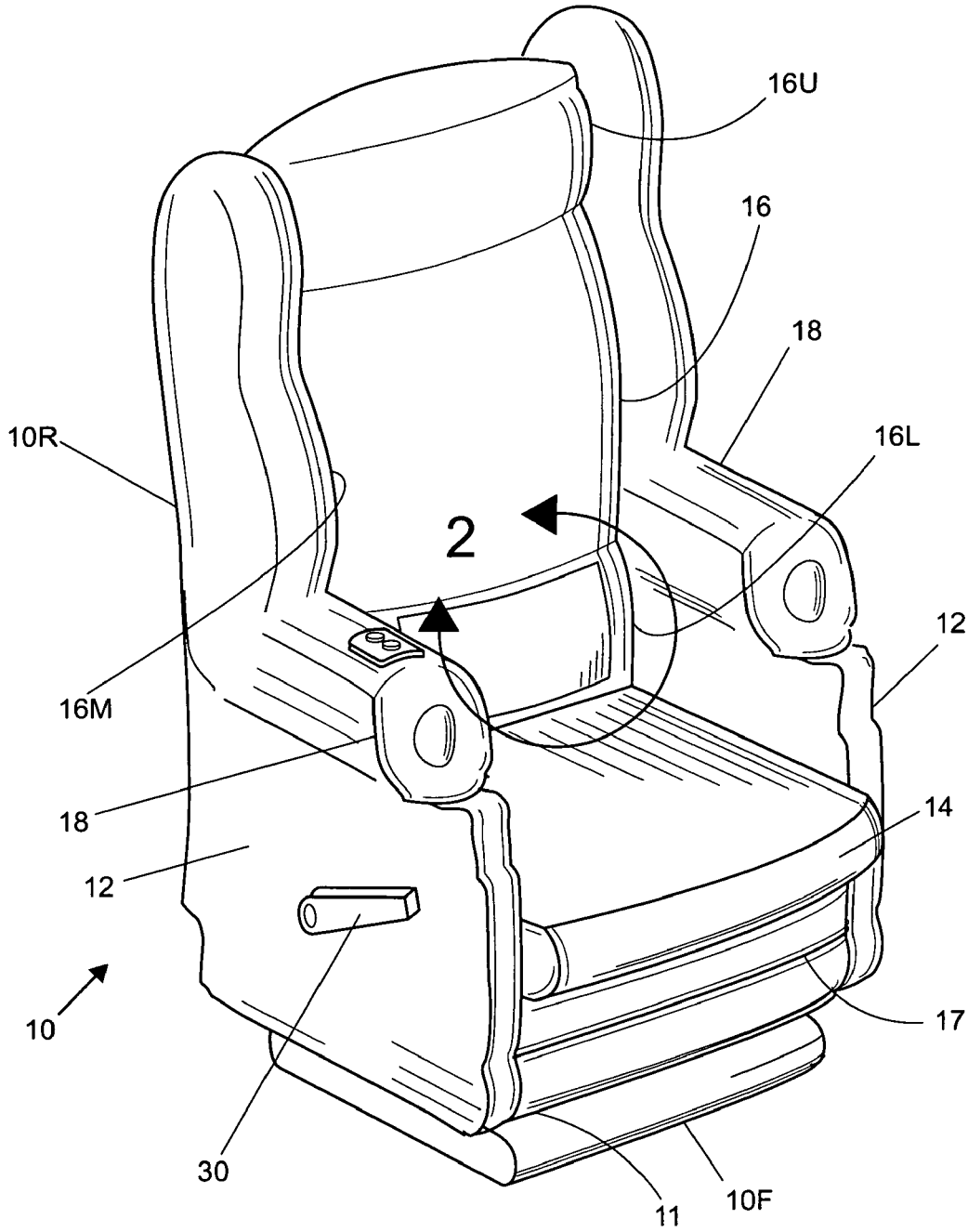
FIG. 1 is a diagrammatic perspective view, illustrating a reclining rocker chair according to the present invention.
Figure 2:
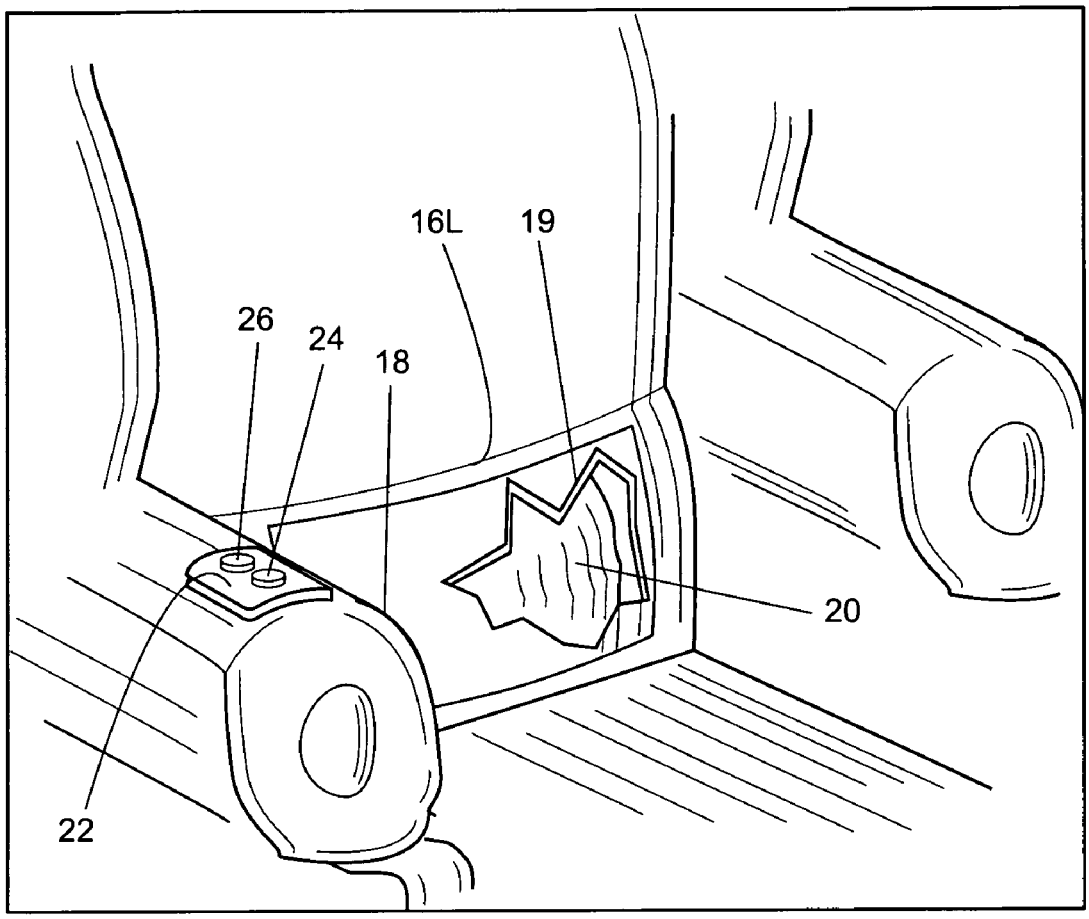
FIG. 2 is an enlarged perspective view, taken generally in the area of circle 2 in FIG. 1, wherein a portion of the chair skin has been broken away to reveal the inflatable chamber therein.

FIG. 1 illustrates a reclining rocker chair 10 having a base 11, a pair of side panels 12, a seat cushion 14 that extends horizontally between the side panels 12, and a chair back 16 that extends upwardly from the base 11, behind and above the seat cushion 14. The chair back 16 includes a lower section 16L, a mid section 16M, and an upper section 16U. The chair has a front surface 10F and a rear surface 10R. The chair 10 includes a pair of armrests 18 that extend horizontally atop the side panels 12 between the front 10F and rear 10R. A footrest 17 is also located at the front 10F of the base 11. The chair has an internal framework, and has a skin 19 that extends over the framework (as seen in FIG. 2). The skin may be vinyl, leather, fabric, or any other suitable material.

In accordance with the present invention, an inflatable chamber 20 is located within the chair back 16. In particular, as illustrated in FIG. 2, the inflatable chamber 20 is located behind the skin 19 of the chair 10 at the lower section 16L of the chair back 16. The inflatable chamber 20 is in communication with a controllable air source, for selectively pressurizing the inflatable chamber 20 so that it presses against the lower back of a user while seated in the chair 10. In particular, the inflatable chamber 20 should press against the lumbar region of the lower back. To ensure safety, a pressure sensor is preferably provided in conjunction with the inflatable chamber to stop it from inflating if it is about to be over-inflated, or if the internal pressure is otherwise too great to safely provide the desired therapeutic effect.

In order for a user to choose inflation of the chamber 20, a remote control 22 is provided. The remote control 22 is illustrated as being positioned upon one of the armrests 18. The remote control 22 may be removed from the armrest 18 and held by the user if desired. The remote control 22 preferably has an inflation button 24, which causes the air source to inflate the inflatable chamber 20, and a deflation button 26, which causes the inflatable chamber 20 to relieve air pressure therein through a release valve or other appropriate structure.

Figure 3:
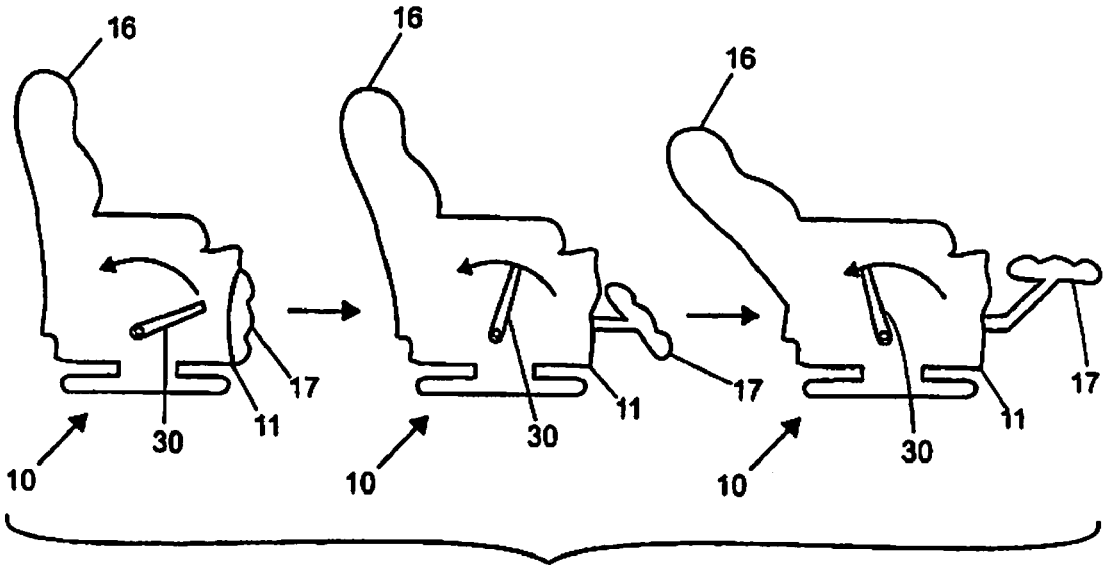
FIG. 3 is a diagrammatic side elevational view, illustrating a sequence drawing figures that show the reclining function of the chair.

Further illustrated in FIG. 3 is a reclining feature of the chair 10. In particular, when selected by the user, the chair back 16 can extend rearwardly and the footrest 17 can extend forwardly from the base 11. Referring momentarily to FIG. 1, a reclining handle 30 may be located on one of the side panels 12. As illustrated in FIG. 3, moving the reclining handles 30 can cause the chair to recline partially, or fully, as the sequence of images indicates. In addition, the reclining function can be motorized and incorporated in the remote control 22, so that the user can cause the chair to recline without the need to operate the reclining handle 30. This would be especially helpful for people who are in extreme pain and cannot bend even slightly to operate the reclining handle 30.

Figure 4:
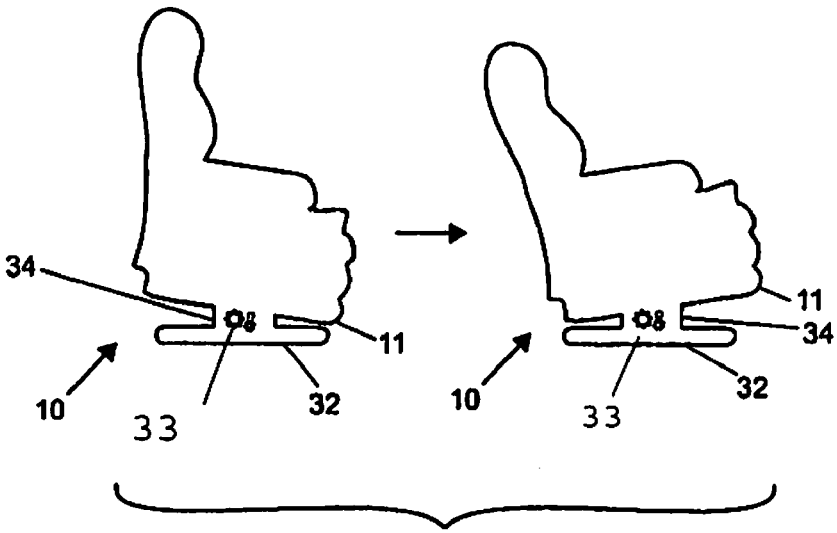
FIG. 4 is a diagrammatic side elevational view, illustrating a pair of drawing figures that show the rocking function of the chair.

Also illustrated in FIG. 4, the chair 10 can include stand 32 that supports the base 11 and a neck 34 that attaches the base 11 to the stand 32. This arrangement facilitates rocking, as illustrated in FIG. 4. In addition, the rocking feature can also be implemented by motor 33, by providing an eccentric shifting weight 33 that creates a resonant motion that builds into a gentle rocking. This rocking feature can be controlled using the remote control 22 as well.

In conclusion, herein is presented a reclining rocking chair that includes an inflatable chamber to provide the user with lower back support when needed. The invention is illustrated by example in the drawing figures, and throughout the written description. It should be understood that numerous variations are possible, while adhering to the inventive concept. Such variations are contemplated as being a part of the present invention.

What is claimed is:

1. A reclining rocking chair with inflatable lumbar support, comprising:

a base; said base having a footrest portion a seat cushion;

a chair back having lower, middle, and upper sections, the lower section having a controllable air source having an inflatable chamber comprising a pressure sensor in conjunction with the inflatable chamber for determining if pressure within the inflatable chamber is too great to safely provide a desired therapeutic effect, and a remote control for varying air pressure within the inflatable chamber;

wherein said reclining rocking chair is capable of being moved into a reclining position wherein said chair back pivots relative to said base and said footrest portion extends away from said base;

wherein said reclining rocking chair is capable of being moved in a rocking motion by a motor and an eccentric shifting weight when in said reclining position; and wherein said remote control is capable of controlling said motor in moving said chair into said reclining position and said rocking motion.

2. The reclining rocking chair as recited in claim 1, the chair having a front surface, a rear surface and further comprising a pair of armrests that extend the side panels between the front and rear surfaces.

3. The reclining rocking chair as recited in claim 2, wherein the chair has a skin, and wherein the inflatable chamber is located behind the skin of the chair at the lower section of the chair back.

4. The reclining rocking chair as recited in claim 2, wherein said remote control in located inside one of said pair of armrests.

* * * * *